US011745970B1

(12) United States Patent
Duncan

(10) Patent No.: US 11,745,970 B1
(45) Date of Patent: Sep. 5, 2023

(54) AUTOMATIC SLEEVING SPLICER AND METHODS OF MAKING AND USING THE SAME

(71) Applicant: Elisa M. Duncan, Apex, NC (US)

(72) Inventor: Elisa M. Duncan, Apex, NC (US)

( * ) Notice: Subject to any disclaimer, the term of this patent is extended or adjusted under 35 U.S.C. 154(b) by 0 days.

(21) Appl. No.: 18/117,176

(22) Filed: Mar. 3, 2023

(51) Int. Cl.
*B65H 19/18* (2006.01)
*B65H 21/00* (2006.01)

(52) U.S. Cl.
CPC ..... *B65H 19/1836* (2013.01); *B65H 21/00* (2013.01); *B65H 2301/4631* (2013.01); *B65H 2301/46172* (2013.01)

(58) Field of Classification Search
CPC .... B65H 19/20; B65H 19/102; B65H 19/286; B65H 19/1836; B65H 21/00; B65H 2301/46172; B65H 2301/4631; B65H 19/1831; B65H 19/1842
See application file for complete search history.

(56) References Cited

U.S. PATENT DOCUMENTS 3,654,035 A * 4/1972 Takimoto ..... B29C 66/43 156/504
3,836,089 A * 9/1974 Riemersma ..... B65H 23/16 242/417.3
3,939,031 A * 2/1976 Takimoto ..... B29C 66/83517 156/304.3
4,106,974 A * 8/1978 Hirsch ..... B65H 19/1873 156/507
4,190,475 A * 2/1980 Marschke ..... B65H 19/1873 226/97.1
4,331,301 A * 5/1982 Martinez ..... B65H 19/1873 242/556.1
6,082,661 A * 7/2000 Focke ..... B65H 19/1852 242/554.3
2004/0084133 A1* 5/2004 Adami ..... B65H 19/1836 156/159
2004/0084561 A1* 5/2004 Clifford ..... B65H 23/032 242/598.2
2004/0149853 A1* 8/2004 Fairchild ..... B65H 19/1836 242/555
2007/0044898 A1* 3/2007 Hikita ..... B65H 19/1836 156/159
2015/0047772 A1* 2/2015 Van Heck ..... B29C 65/5092 156/503
2017/0137248 A1* 5/2017 Sato ..... B65H 19/102
2017/0369265 A1* 12/2017 Murgia Mendizabal ..... B65B 41/12
2018/0162668 A1* 6/2018 Hong ..... B65H 19/102

* cited by examiner

*Primary Examiner* — William A. Rivera
(74) *Attorney, Agent, or Firm* — Ashley D. Johnson; Dogwood Patent and Trademark Law

(57) ABSTRACT

An apparatus and method for automatic splicing of rolls of sleeve material used in various packaging applications. The disclosed system will automatically splice the leading end of a new roll onto the trailing end of the old roll in an overlapped configuration. The apparatus performs an automatic cut and splice operation resulting in a splice of the two film rolls with tape applied to both sides of the splice joint where the new roll overlaps the cut end of the prior roll.

11 Claims, 9 Drawing Sheets

AUTOMATIC SLEEVING SPLICER AND METHODS OF MAKING AND USING THE SAME

TECHNICAL FIELD

The presently disclosed subject matter relates generally to an automatic sleeving splicer apparatus and to methods of making and using the disclosed apparatus.

BACKGROUND

In the manufacturing field, shrink sleeve applicators are used to cut sections of thermoplastic film and apply the cut film onto various types of products. As heat is applied to the film, it contracts and conforms to the shape of an associated product (e.g., often in the form of a tamper evident band and/or decorative sleeve). Generally, conventional shrink sleeve applicators employ film sourced from a running web roll that is currently in use and a ready web roll that provides a source of web once the running web roll expires. When the running roll is about to expire, the shrink sleeve applicator typically stops running to allow the roll of film to be changed. A spliced segment of the running web is then separated from the substantially empty roll core and the ready web is brought up to line speed. The physical splice between a trailing edge of an outgoing running web and a leading edge of a replacement ready web can be completed using various methods. For example, a butt splice is often used, wherein the trailing edge of the depleted running web roll and the leading edge of the ready web roll are abutted against one another and joined. The joining of the two edges is typically accomplished with an adhesive tape applied to a top and bottom edge of the abutment. However, the formation of a butt splice can be difficult, requiring stopped machinery and/or a high degree of precision and accuracy. Specifically, an improper butt splice can lead to a gap between the two edges of web material, leaving exposed adhesive, which may cause problems as the gap and exposed adhesive proceed through the associated machinery or equipment. It would therefore be beneficial to provide a web splicing apparatus that overcomes the shortcomings of the prior art, allowing the ready film roll to be spliced into the running web without stopping production of the shrink sleeve applicator.

SUMMARY

In some embodiments, the presently disclosed subject matter is directed to a tubular film splicing apparatus. Specifically, the apparatus is defined by an upper manifold comprising a front face and a lower manifold comprising a front face. The apparatus includes an opening positioned between the upper and lower manifolds. The apparatus further includes a cutting element. The upper manifold and the lower manifold rotate between a first orientation in which the upper manifold and lower manifold front faces extend in a first direction, and a second orientation in which the upper manifold and lower manifold front faces are positioned to face each other.

In some embodiments, the cutting element is selected from a knife, blade, or laser.

In some embodiments, the front face of the upper manifold and the front face of the lower manifold comprise vacuum suction.

In some embodiments, the apparatus includes an actuator to provide the rotation of the upper and lower manifolds.

In some embodiments, the upper and lower manifolds rotate about 90 degrees.

In some embodiments, the upper and lower manifold front faces contact each other in the second orientation.

In some embodiments, the apparatus comprises a shuttle configured to move between a first set of upper and lower manifolds and a second set of upper and lower manifolds.

In some embodiments, the presently disclosed subject matter is directed to a method of creating an overlapping joint of two tubular films. Specifically, the method comprises positioning a first portion of tape defined by an adhesive side and a non-adhesive side on the front face of the upper manifold the disclosed apparatus such that the non-adhesive side contacts the front face of the upper manifold. The disclosed apparatus comprises an upper manifold comprising a front face and a lower manifold comprising a front face. The apparatus includes an opening positioned between the upper and lower manifolds. The apparatus further includes a cutting element. The upper manifold and the lower manifold rotate between a first orientation in which the upper manifold and lower manifold front faces extend in a first direction, and a second orientation in which the upper manifold and lower manifold front faces are positioned to face each other. The method includes positioning a second portion of tape defined by an adhesive side and a non-adhesive side on the front face of the lower manifold such that the non-adhesive side contacts the front face of the lower manifold. The method further includes feeding a leading edge of a first tubular film through the opening between the upper and lower manifolds. The method includes cutting the leading edge of the first tubular film using the cutting element as applied by the operator to create an upper portion of film and a lower portion of film either before or after feeding the first tubular film through the opening. The method comprises advancing the upper portion of film and lower portion of film of the first tubular film between the first and second manifolds such that the upper portion of film contacts the adhesive side of the first portion of tape and the lower portion of film contacts the adhesive side of the second portion of tape. The method comprises positioning the trailing edge of a second tubular film in alignment with the first tubular film. The method comprises rotating the front faces of the upper and lower manifolds from the first orientation to the second orientation, whereby the adhesive side of the first portion of tape is adhered to a top face of the second tubular film and the adhesive side of the second portion of tape is adhered to a bottom face of the second tubular film. The first tubular film and second tubular film are spliced via an overlapping joint wherein the trailing edge of the second tubular film is aligned within an interior of the first tubular film.

In some embodiments, the tubular film splicing apparatus is used with shrink sleeve applicator machinery, and wherein the machinery continues to run while the overlapping joint is created.

In some embodiments, the first tubular film is a new roll of a film and the second roll of film is an expiring roll of film.

In some embodiments, the first tubular film and the second tubular film are shrink films.

In some embodiments, the first tubular film and the second tubular film are multilayer polymeric films.

In some embodiments, the method comprises using a shuttle to position the trailing edge of the second tubular film between a first set of upper and lower manifolds and a second set of upper and lower manifolds.

BRIEF DESCRIPTION OF THE DRAWINGS

The previous summary and the following detailed descriptions are to be read in view of the drawings, which illustrate some (but not all) embodiments of the presently disclosed subject matter.

DETAILED DESCRIPTION

Figure 1:
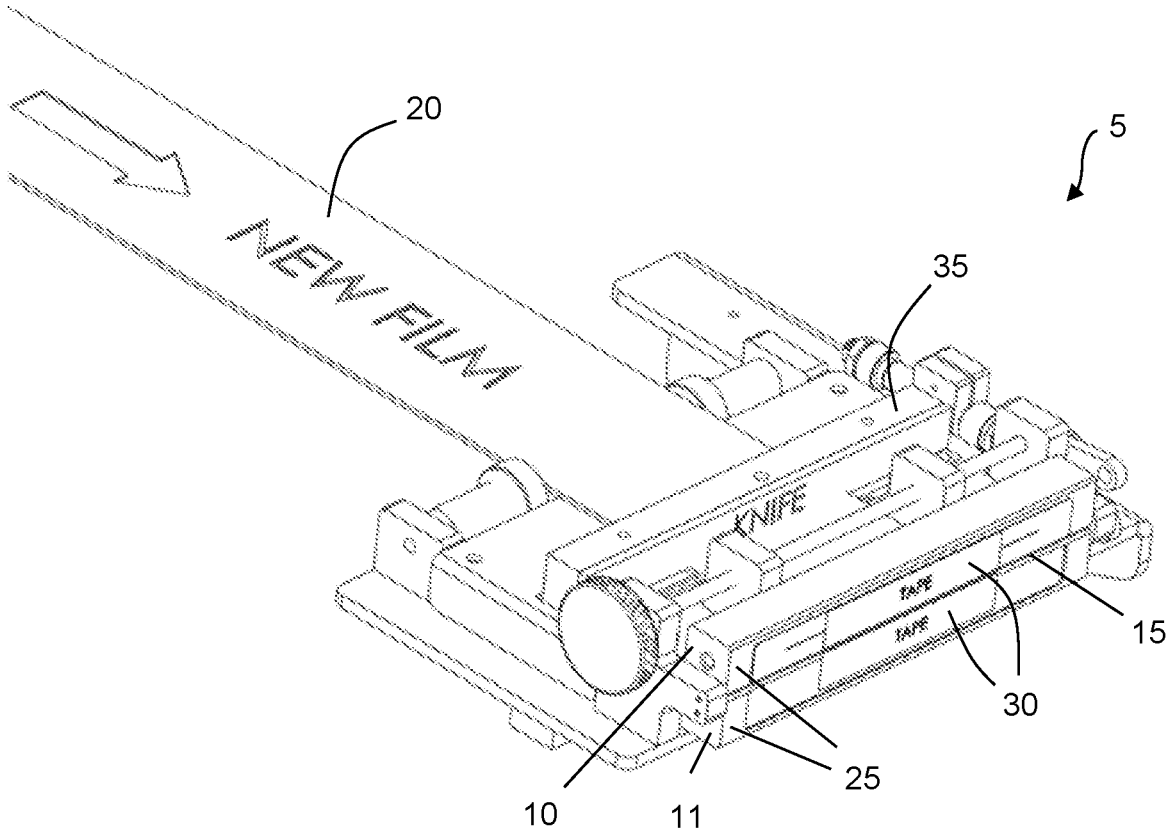
FIG. 1 is a perspective view of a splicer head in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

The presently disclosed subject matter is directed to an automatic splicing apparatus for use in splicing tubular webs. The disclosed apparatus is configured to splice two rolls of tubular web together, enabling the associated shrink sleeve applicator machinery to continue running without stopping the machine from operating. Importantly, the disclosed apparatus creates an overlapping joint of the tubular films from each roll. Specifically, the trailing edge of the running film roll ("the old film") is aligned inside the ready film roll ("the new film") at the leading edge, creating an "old inside new" arrangement, as discussed in detail below. Adhesive tape (or any other suitable securing element) is applied on each side of the spliced film at the joint between the new and old films. Thus, the disclosed splicing apparatus is configured to provide a non-stop supply of film material to downstream application systems using a unique and beneficial overlapped arrangement.

The disclosed splicing apparatus is designed to operate in the framework of an unwinding device for supplying a web material to a shrink sleeve applicator machine that uses it (not illustrated) constituted typically by one of the workstations of a manufacturing plant. Such applications are well known in the art as described in U.S. Patent/Publication Nos. 9,637,340; 10,457,512; 11,447,356; and 2017/00190452, the entire contents of which are incorporated by reference herein. However, it should be appreciated that even though the disclosed invention has been developed with particular attention paid to this possible field of application, the scope of the invention itself is not in itself limited to shrink sleeve applicators and can be used in any packaging market.

The disclosed web splicing apparatus is typically used in an environment comprising an old roll of film and a new roll of film that are intended to be spliced together. Specifically, the old roll is currently being fed and the new roll will be spliced into operation. The term "old roll" refers to the roll of tubular film currently in use that will be expiring as the amount of film present is used. The term "new roll" refers to the most recently loaded roll of tubular film comprising a leading edge onto which the trailing end of the old roll of film will be joined. The term "leading edge" refers to the most forward edge with respect to the direction of travel. The term "trailing edge" refers to the edge opposite to the leading edge with respect to the direction of travel. The term "splice" refers to the act or result of joining the trailing end of the old film roll with the leading edge of the new film roll to form a continuous web. Thus, the web unwound from the old roll represents the web in use, while the web from the new roll is spliced to the old roll before the exhaustion of the latter.

In use, the old film roll and new film roll can generally be moved through the splicer and/or associated machinery by a series of motorized rollers. The old and new films can generally have a flattened and tubular shape with a thickness suitable for being fed through the splicer 5. At a trailing edge, the outgoing web can be spliced with a leading edge of a replacement web from the new roll to continue the unwinding process. For example, in an unwinding process, when the old roll containing outgoing web is depleted or nearly depleted, a trailing edge of the outgoing web can be spliced with a leading edge of the replacement web, such that the replacement web can continue feeding the unwinder. The replacement web is typically the same or a similar material as the outgoing web.

The term "web" or "film" refers to a thin ribbon of tubular and flexible material, such as (but not limited to) polymeric shrink film. The term "tubular film" refers to a film formed into a cylindrical and flat tube shape that is wound on a roll for storage. Thus, the tubular film has an inner and outer face versus being a single layer of material. The term "shrink film" refers to any polymer film material that can be shrunk to fit around and secure one or more items. Without being bound by theory, shrinkage may occur due to relaxation of the orientation stresses of the plastics during the shrink process. Typically, the shrink film application machinery opens the film using associated tooling, which can be problematic if butt splices are present (e.g., the tape can stick together, catching the tooling and stopping production).

The tubular film can be a single layer or multilayer film produced by any suitable method, such as coextrusion of a blown film. However, any method can be used to create the tubular film.

FIG. 1 illustrates one embodiment of splice apparatus 5 that accomplishes the disclosed splicing operation. The splicer comprises stacked upper and lower manifolds 10, 11 with central opening 15 that passes between the manifolds. The central opening thus runs the entire length of the distance between the manifolds. A pneumatic clamp, vacuum, or any other suitable retention element can be used to hold the new film in place and to prevent movement before and during splicing. Each manifold includes front face 25 that is configured to rotate from a first position (illustrated in FIG. 1) to a second position (illustrated in FIG. 4) wherein the front faces are in direct contact and facing each other to achieve the splicing operation, as discussed in detail below. Any method can be used to enable rotation of the upper and lower manifolds, such as the use of an actuator.

Apparatus 5 can be configured with an adhesive material (e.g., adhesive tape 30) that can be used to couple together the new and old films. The adhesive material can include an adhesive side and non-adhesive side. The adhesive side includes one or more adhesive materials (e.g., one or more materials that are capable of bonding and/or attaching to a film). Suitable adhesives can include (but are not limited to) pressure-sensitive adhesives (e.g., styrenic polymer, polyisobutylene, polyacrylate-based or polyisobutylene based adhesives, rubber-based adhesives), synthetic adhesives, natural adhesives (e.g., derived from natural materials or polymers), or combinations thereof. However, the adhesives are not limited, and any desired adhesive(s) can be used. "Non-adhesive" refers to the characteristic of not appreciably adhering to or bonding to a film.

The adhesive side is intended to contact the films at the splice joint to hold the films together. In some embodiments, an operator can manually position the non-adhesive side of each piece of tape on an upper or lower manifold. The non-adhesive side that is held against front face 25 of each of the upper and lower manifolds until the adhesive strip is positioned over the webs. In some embodiments, the front face of manifolds 10, 11 can employ a vacuum suction to hold the non-adhesive side of the adhesive strip against the corresponding manifold front faces 25. Vacuum suction can be accomplished using any suitable method, such as positioning one or more vacuum openings in front face 25 in fluid connection with a vacuum source. Correspondingly, the adhesive side of the adhesive strip faces outward to be properly positioned for adhesion to the films during the splicing operation.

It should be appreciated that the presently disclosed subject matter is not limited and any mechanism can be used to hold the adhesive strip on the front face of each manifold before coupling it to the splice joint (e.g., the apparatus is not limited to the use of vacuum suction). In still other embodiments, apparatus 5 can be fitted with a different type of adhesive, coupling material, or coupling mechanism for positioning the two films together.

A knife assembly prepares the end of the expiring roll. The leading edge of the new roll is prepared by the operator. Specifically, the leading edge of the new roll is fed through opening 15 between manifolds 10, 11. Because the web is tubular, the side edges of the film are slit by the operator, thereby creating a portion of separated upper and lower films 40, 41 at the leading edge of the new film.

Figure 2:
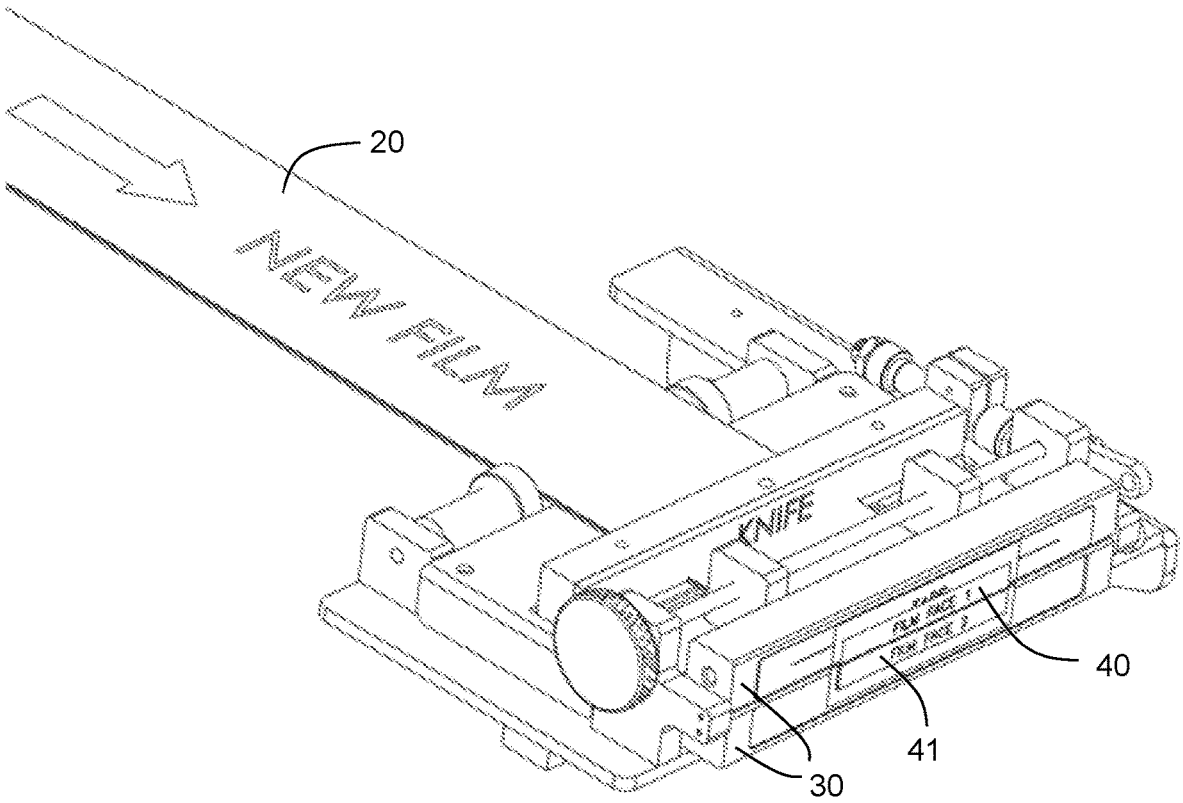
FIG. 2 is a perspective view of a splicer head with the leading edge of a ready film roll in position for an overlapped splicing operation in accordance with some embodiments of the presently disclosed subject matter.

The cutting element can include any element capable of cutting film, such as (but not limited to) a knife, razor, laser, and the like. The split new film leading edge is then extended through opening 15 between the upper and lower manifolds. As shown in FIG. 2, separated upper and lower films 40, 41 are positioned adjacent to the front faces of the upper and lower manifolds, respectively, via vacuum suction and maintained in position by adhesion to the sticky side of adhesive tape 30. In some embodiments, the operator can position the upper and lower films against the adhesive tape 30. In other embodiments, the positioning of the upper and lower films can be automated. The leading edge of new film 20 is now in proper position for splicing to the old film.

Figure 3:
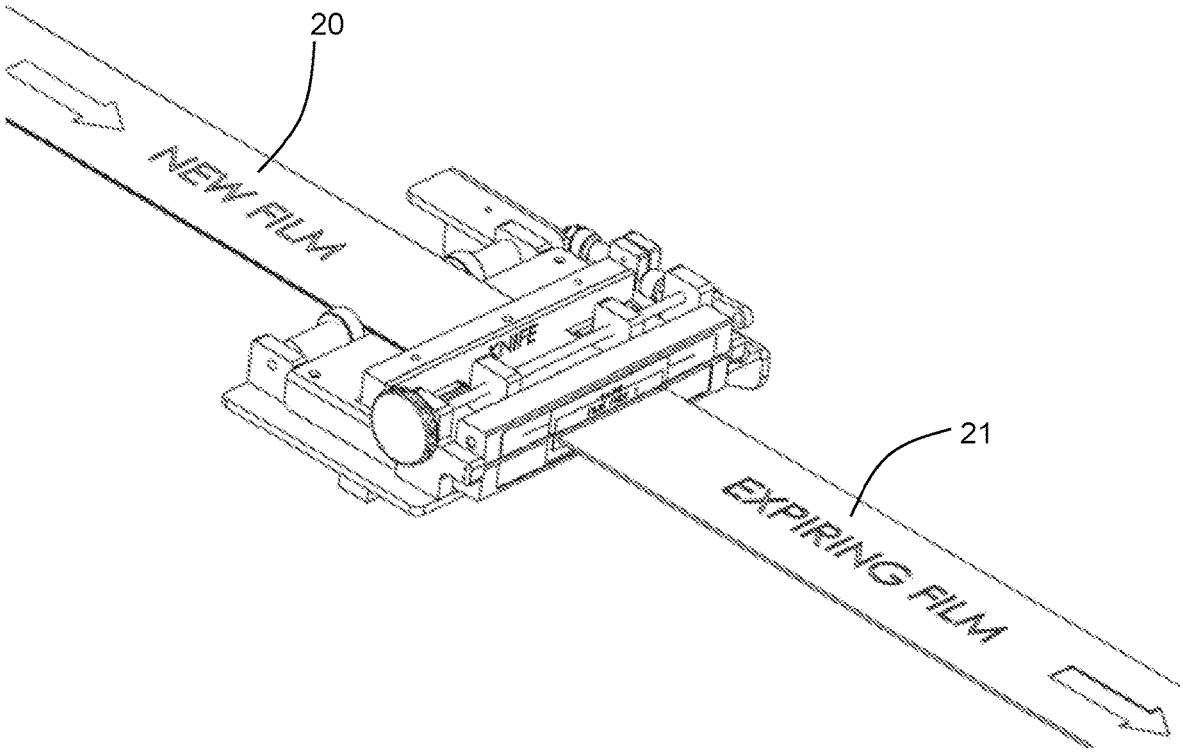
FIG. 3 is a perspective view of a splicer head illustrating the trailing edge of an expiring running film roll in position for an overlapped splicing operation in accordance with some embodiments of the presently disclosed subject matter.

When the old roll has expired or is close to expiring (determined by methods well known in the art), the web is cut and then moved into position in close proximity to the prepared splice of the new roll, as shown in FIG. 3. In some embodiments, the trailing end is positioned adjacent to central opening 15 between the upper and lower manifolds. Thus, upper film 40 is positioned above the trailing end and lower film 41 is positioned below the trailing end, thereby allowing an "old inside new" confirmation to be accomplished. In some embodiments, the trailing edge of the old film is positioned less than 1, 0.9, 0.8, 0.7, 0.6, 0.5, 0.4, 0.3, 0.2, 0.1, 0.05, 0.01, or 0.001 inches from the central manifold opening 15.

Figure 4:
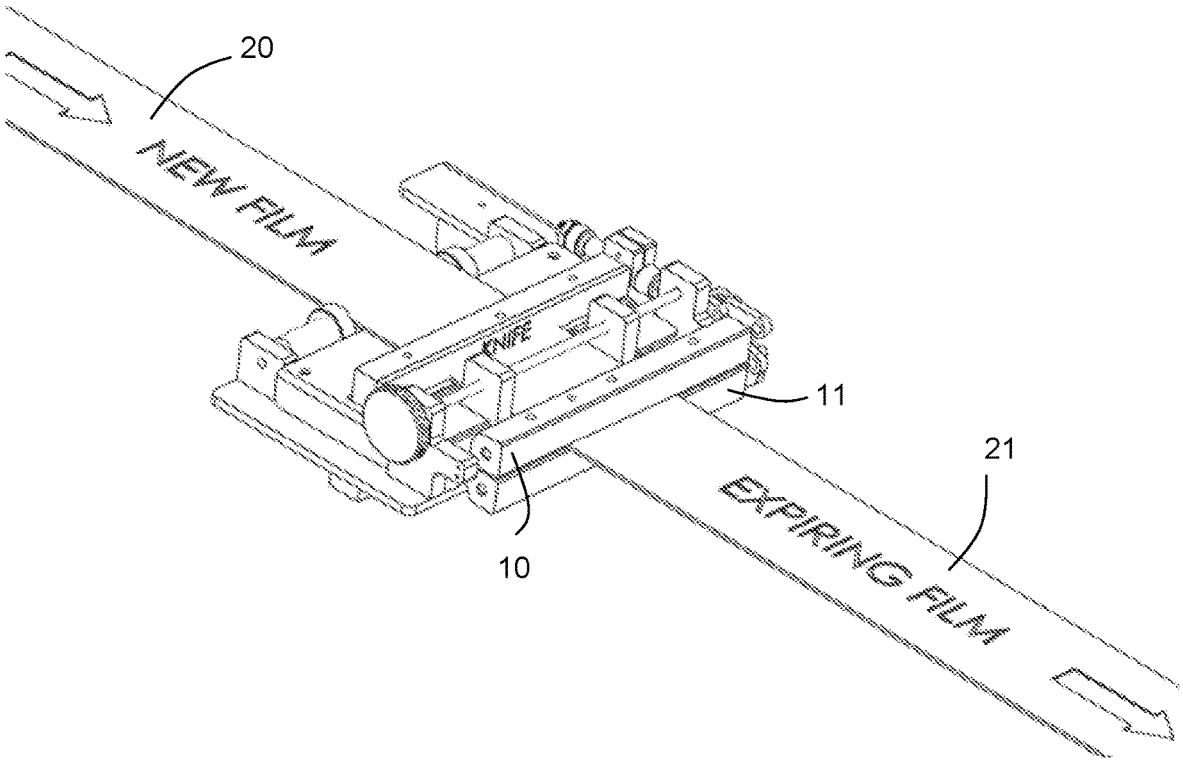
FIG. 4 is a perspective view of upper and lower manifolds of a splicer head performing an overlapped splicing operation in accordance with some embodiments of the presently disclosed subject matter.

The upper and lower manifolds of splicer 5 are then rotated such that front faces 25 are facing each other, as shown in FIG. 4. In some embodiments, the manifold rotate about 90 degrees (e.g., at least/no more than about 45, 50, 55, 60, 65, 70, 75, 80, 85, 90, 95, 100, 105, 110, 115, 120, 125,130, or 135 degrees). As the front faces are pressed together, the trailing edge of the old film is pressed onto the adhesive tape strips. As a result, the spliced ends 40, 41 of new film 20 are adhered (via the tape) around the exterior surface of the old film trailing end. The portion of tape 30 positioned on the front face of the upper manifold is adhered to the top face of the old and new films at the splice joint. The portion of tape positioned on the front face of the lower manifold is adhered to the bottom face of the old and new films at the splice joint. Thus, the old film is positioned within the interior of the new film and maintained via tape 30 via a "trailing edge-in" splice method. Stated another way, the trailing edge of the old film is inserted with the interior of the new film at the new film leading edge, creating a small and overlapped transitioned area 45. As the spliced film passes over the shrink sleeve applicator tooling, positioning the old film inside the new film allows for a smooth transition from one section to the next. In contrast, if the new film were inserted into the old, it would allow the edge of the inner splice to catch on the tooling as it is pulled over, increasing the chance of tearing the film.

Figure 5:
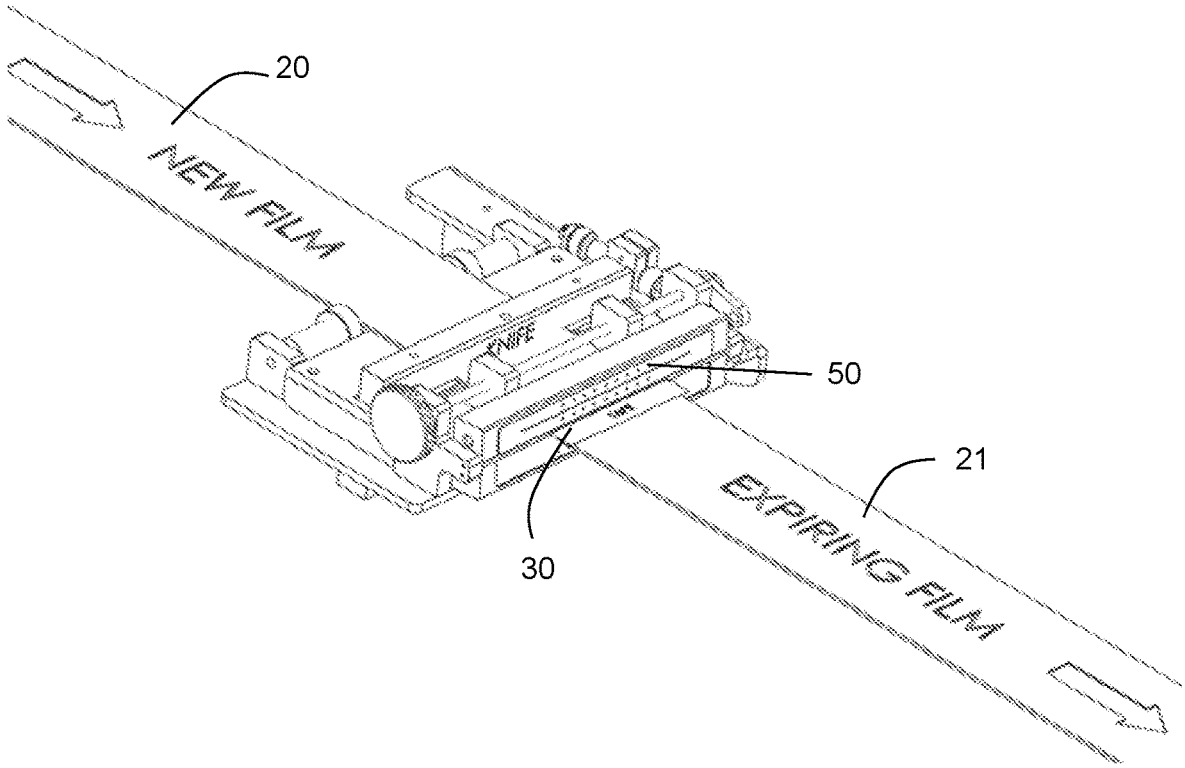
FIGS. 5 and 6 are perspective views of a splicer head after an overlapped splicing operation has been performed in accordance with some embodiments of the presently disclosed subject matter.
Figure 6:
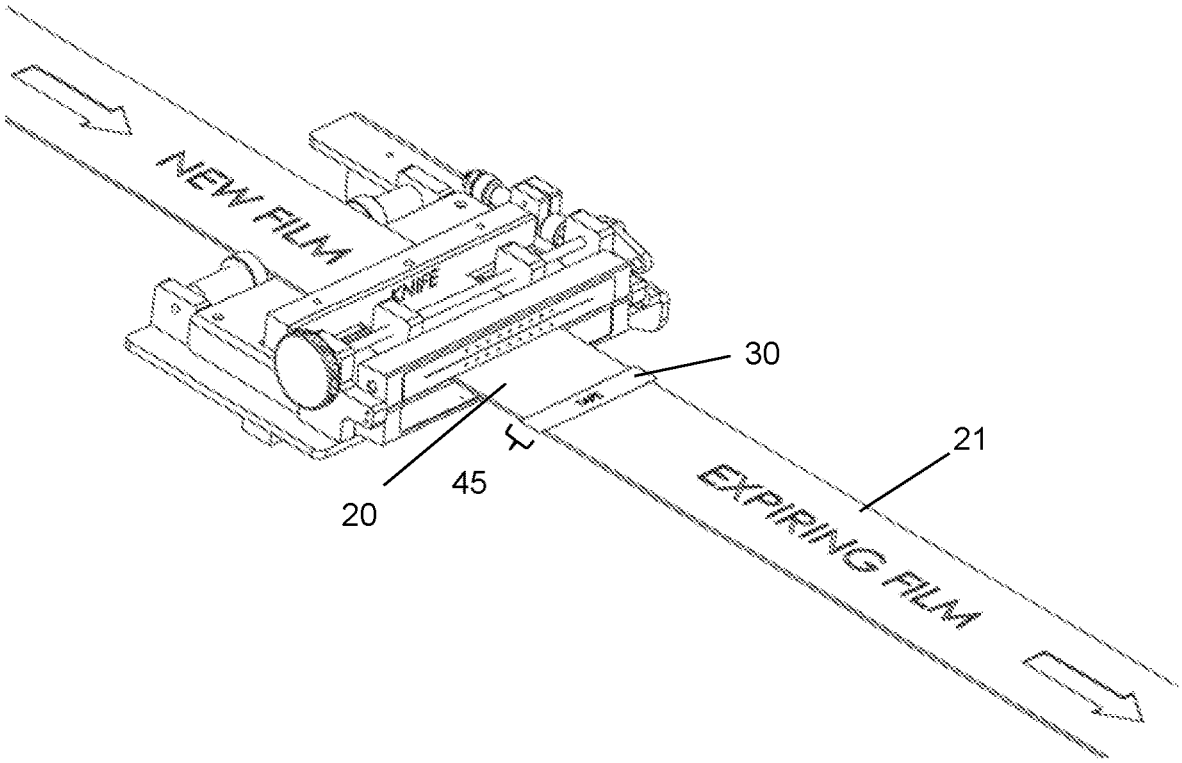

The upper and lower manifold are then rotated back to the original position, as shown in FIG. 5. The new film is then advanced seamlessly, as shown in FIG. 6. The overlapping area 45 of the spliced film is then maintained in contact with each other via the tape.

Figure 7:
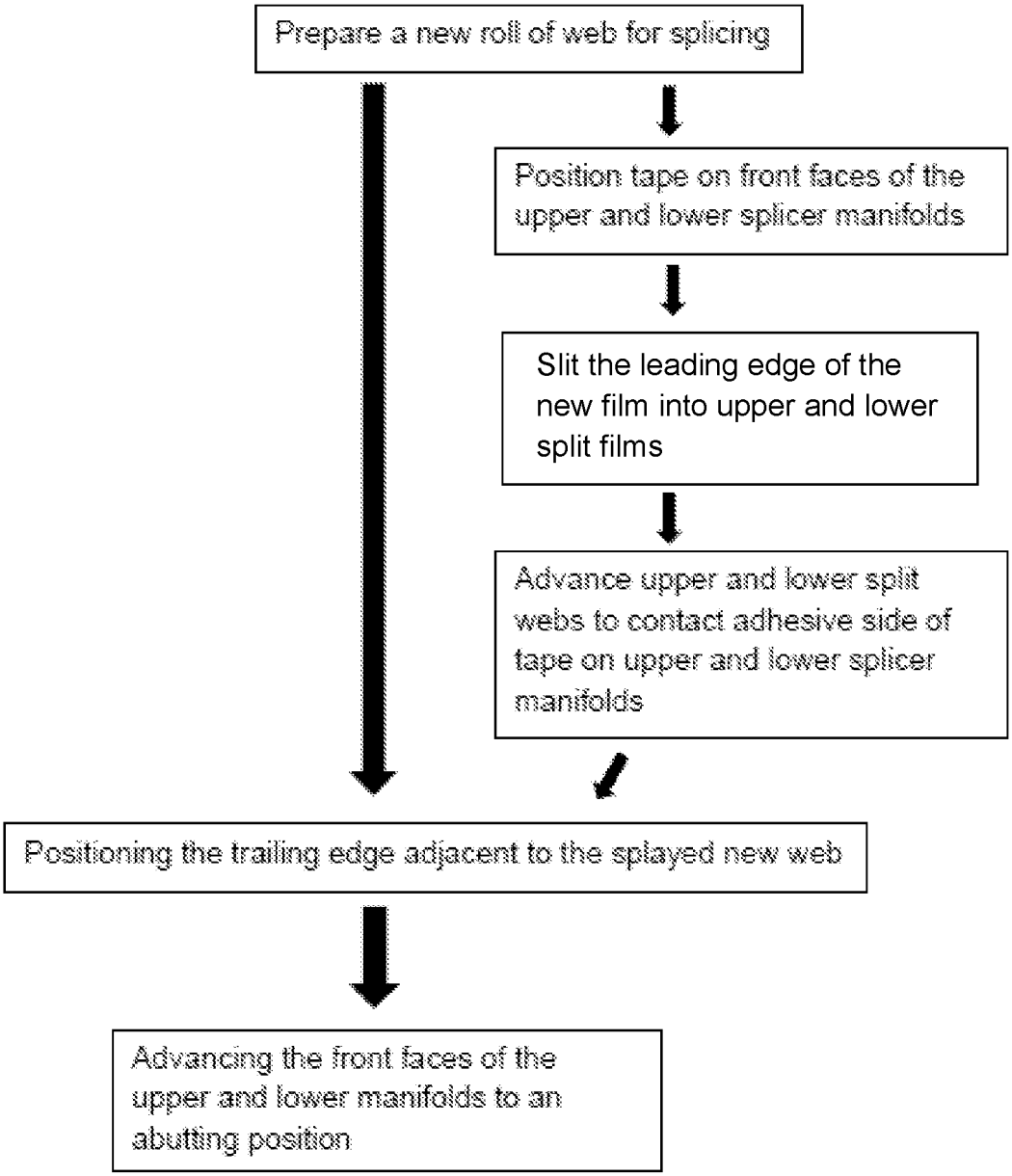
FIG. 7 is a schematic illustrating one method of using the disclosed splicing head in accordance with some embodiments of the presently disclosed subject matter.

Turning now to FIG. 7, one method of splicing a new roll of tubular web into an old roll of tubular web is shown. The disclosed method can include first preparing a new roll of tubular web for splicing. The new roll can be prepared by positioning tape on the front faces of the upper and lower splicer manifolds of an associated splicer head. The tape can be positioned on the front face of each manifold using vacuum holes 50 or any other mechanism. A cutting device is used by the operator to split the sides of the leading edge of the new film, thereby creating upper and lower split films 40, 41. The leading edge can be split into upper and lower films before or after the leading edge of the new film is advanced through the opening between the upper and lower manifolds. The upper split web is then positioned against a portion of tape held on the upper manifold, and the lower split web is positioned against the adhesive portion of tape held on the lower manifold.

After the new film is prepared, the method includes preparing the old roll of film for splicing. Specifically, the trailing edge of the old film is cut and positioned adjacent to the prepared new roll of film.

After the new web and old web are prepared for splicing, the front faces of the splice head upper and lower manifolds are rotated to an abutting (facing) position. As a result, the adhesive portion of tape positioned on the upper manifold is adhered to the top face of the old film at the trailing edge and is also adhered to the upper splayed portion of the new film. In this way, the upper film of the new web leading edge is adhered to the top face of the old film. Similarly, the adhesive portion of tape positioned on the lower manifold is adhered to the bottom face of the old film at the trailing edge and is also adhered to the lower splayed portion of the new film. Accordingly, the new film leading edge is spliced to the trailing edge of the old film (e.g., the trailing edge is positioned within the interior of the new web at the leading edge). The spliced film can then be used, becoming the new film for the desired manufacturing activity. The spliced film can be drawn towards the festoon to continue with operations seamlessly and without ceasing operations of the line.

Figure 8A:
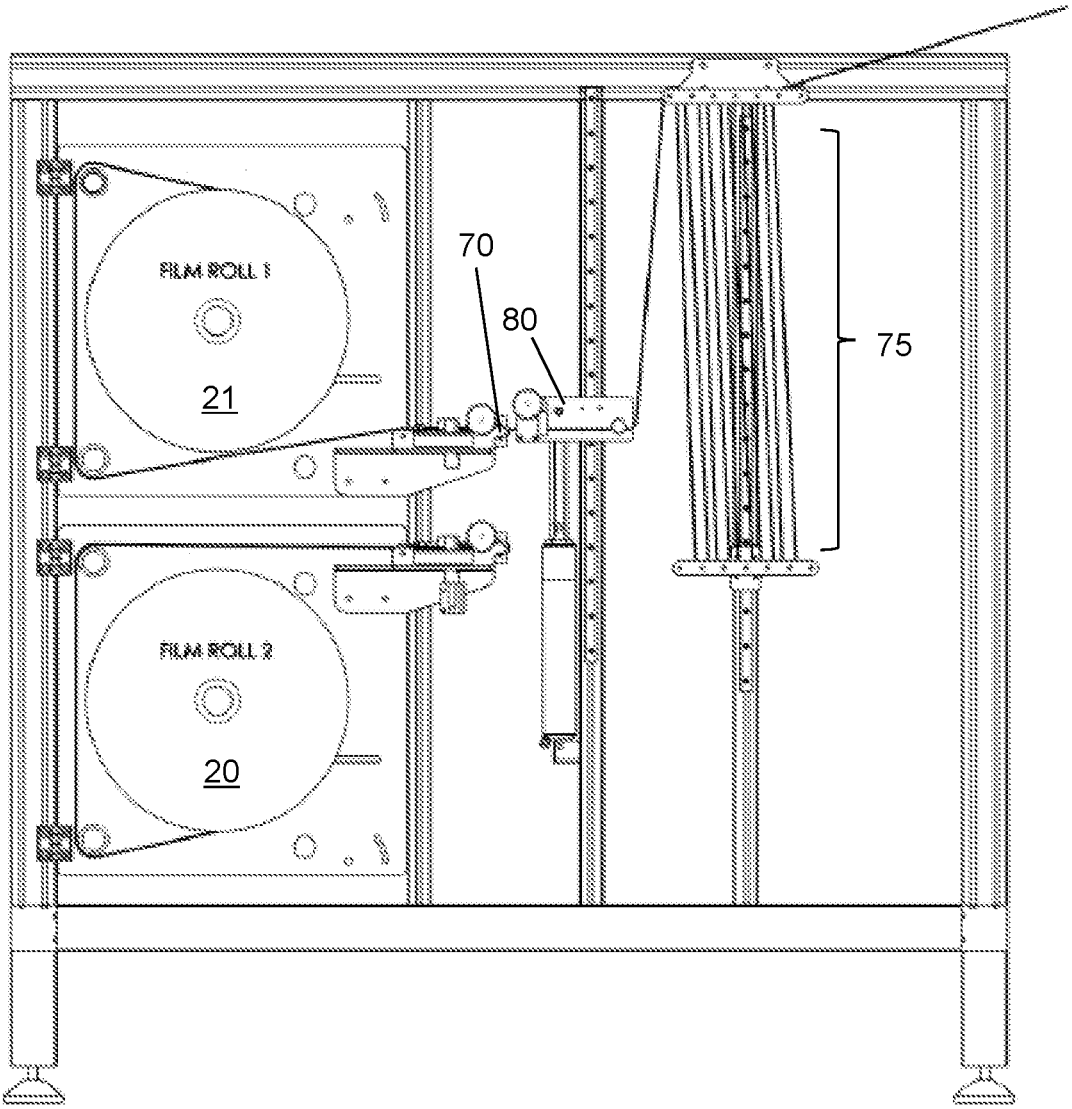
FIGS. 8*a* and 8*b* are side plan views of a system comprising a shuttle in accordance with some embodiments of the presently disclosed subject matter.
Figure 8B:
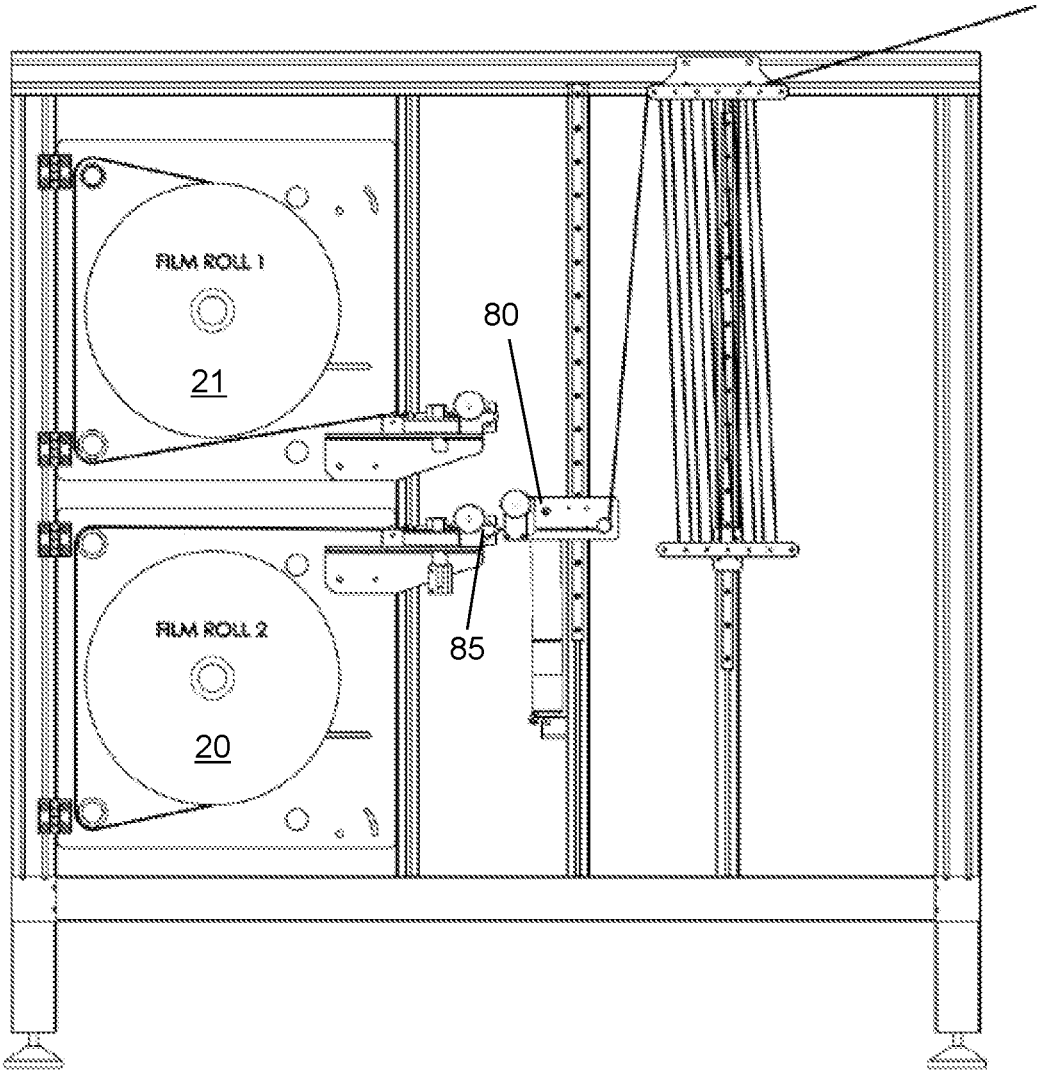

FIGS. 8*a* and 8*b* illustrate one example of positioning the two film rolls in proper position for splicing. As shown, the running roll is orientated in the upper position, above the ready roll. Old film 21 from the running roll passes through upper splice head 70 through a series of guide shafts and rollers associated to festoon 75. The film then proceeds to the sleeving machinery. FIG. 8*a* illustrates the old film of the running roll in use with shuttle 80 in an upper position, adjacent to the upper splice head 70. The ready roll of new film 20 is positioned below the running roll of old film 21, and the leading edge of the ready roll has been prepared and is ready to splice (e.g., the tape has been applied to the front faces of the upper and lower manifolds, the tubular film edges have been sliced and positioned adjacent to the adhesive side of the tape as described in detail above and shown in FIG. 2).

The splice machinery detects when the running roll is expiring and stops the roll from spinning. The tail of the running roll old film is then stopped and cut to form a clean edge for splicing. The sleeve applicator pulls web from the festoon accumulation area, allowing production to continue. After the tail of the old film is cut, it is securely held in position on the shuttle assembly. Specifically, shuttle 80 moves the cut web tail into position to align with the ready roll new film at the lower station, as shown in FIG. 8*b*. Once the tail is in position, lower splice head 85 applies the splice onto the expired tail of the old roll. The ready roll then begins to spin to refill the festoon accumulator. It is noted that the sleeve applicator has not stopped production during the splicing.

It should be appreciated that FIGS. 8*a* and 8*b* illustrate one embodiment of two film rolls positioned in a vertical orientation (e.g., film 1 above film 2). The presently disclosed subject matter can also be useful in arrangements wherein the film rolls are positioned in a horizontal orientation. In these embodiments, the shuttle can move from left to right instead of up and down.

Advantageously, the disclosed splicer allows splicing of the old and new films to be performed without interrupting the running of the shrink sleeve applicator, and therefore provides for efficient splicing with little to no lost production time.

Because the splice can be performed while the shrink sleeve applicator is running, the disclosed apparatus allows for increased throughput and minimal revenue loss.

Additionally, the splice can be performed automatically without human interaction once the new roll has been prepared. Devices, systems, and methods of the present disclosure may create a stable splice capable of passing through additional rollers or other equipment without issue. For example, a splice of the disclosed apparatus is formed as an overlapped splice, thus reducing issues caused by butt splices (e.g., gaps or exposed tape).

Accordingly, the disclosed apparatus and method is especially suitable for use in the packaging industry, although not being limited to that application.

The disclosed splicer is relatively compact and has a small footprint.

The disclosed splicer minimizes the amount of misaligned web delivered to a downstream web-consuming machine following each splice.

The disclosed apparatus and method allows for easy, efficient, and convenient splicing of two webs.

The disclosed splicer produces high quality overlapped splices between webs on a consistent basis.

The present invention has been described in accordance with various illustrative embodiments. However, it is expressly contemplated that the principles of the present invention may be implemented in a plurality of alternative embodiments. The various components and their orientations in exemplary splicing apparatus may be varied dependent on implementation requirements. For example, while an upper roll and lower roll have been described and shown, the principles of the present invention may be utilized with rolls in differing orientations, e.g., side by side. Therefore, the various descriptions of operations, the order in which they are performed, particular components and their orientations, etc. should be taken as exemplary only.

What is claimed is:

1. A tubular film splicing apparatus defined by:

an upper manifold comprising a front face;

a lower manifold comprising a front face;

an opening positioned between the upper and lower manifolds;

a cutting element;

a shuttle configured to move between a first set of upper and lower manifolds and a second set of upper and lower manifolds;

wherein the upper manifold and the lower manifold rotate between a first orientation in which the upper manifold and lower manifold front faces extend in a first direction, and a second orientation in which the upper manifold and lower manifold front faces are positioned to face each other.

2. The tubular film splicing apparatus of claim 1, wherein the cutting element is selected from a knife, blade, or laser.

3. The tubular film splicing apparatus of claim 1, wherein the front face of the upper manifold and the front face of the lower manifold comprise vacuum suction.

4. The tubular film splicing apparatus of claim 1, further comprising an actuator to provide the rotation of the upper and lower manifolds.

5. The tubular film splicing apparatus of claim 1, wherein the upper and lower manifolds rotate about 90 degrees.

6. The tubular film splicing apparatus of claim 1, wherein the upper and lower manifold front faces contact each other in the second orientation.

7. A method of creating an overlapping joint of two tubular films, the method comprising:

positioning a first portion of tape defined by an adhesive side and a non-adhesive side on the front face of the upper manifold of claim 1 such that the non-adhesive side contacts the front face of the upper manifold;

positioning a second portion of tape defined by an adhesive side and a non-adhesive side on the front face of the lower manifold such that the non-adhesive side contacts the front face of the lower manifold;

feeding a leading edge of a first tubular film through the opening between the upper and lower manifolds;

cutting the leading edge of the first tubular film using the cutting element to create an upper portion of film and a lower portion of film either before or after feeding the first tubular film through the opening;

advancing the upper portion of film and lower portion of film of the first tubular film between a first manifold and a second manifold such that the upper portion of film contacts the adhesive side of the first portion of tape and the lower portion of film contacts the adhesive side of the second portion of tape;

positioning the trailing edge of a second tubular film in alignment with the first tubular film;

rotating the front faces of the upper and lower manifolds from the first orientation to the second orientation, whereby the adhesive side of the first portion of tape is adhered to a top face of the second tubular film and the adhesive side of the second portion of tape is adhered to a bottom face of the second tubular film;

using the shuttle to position the trailing edge of the second tubular film between the first set of upper and lower manifolds and the second set of upper and lower manifolds;

whereby the first tubular film and second tubular film are spliced via an overlapping joint wherein the trailing edge of the second tubular film is aligned within an interior of the first tubular film.

8. The method of claim 7, wherein the tubular film splicing apparatus is used with shrink sleeve applicator machinery, and wherein the machinery continues to run while the overlapping joint is created.

9. The method of claim 7, wherein the first tubular film is a new roll of a film and the second roll of film is an expiring roll of film.

10. The method of claim 7, wherein the first tubular film and the second tubular film are shrink films.

11. The method of claim 7, wherein the first tubular film and the second tubular film are multilayer polymeric films.

* * * * *